US007757311B2

(12) United States Patent
Garneau

(10) Patent No.: US 7,757,311 B2
(45) Date of Patent: Jul. 20, 2010

(54) SEAT PAD FOR CYCLIST GARMENT AND METHOD OF MANUFACTURE

(75) Inventor: Louis Garneau, Saint-Augustin-de-Desmaures (CA)

(73) Assignee: Louis Garneau Sports Inc. (CA)

( * ) Notice: Subject to any disclaimer, the term of this patent is extended or adjusted under 35 U.S.C. 154(b) by 194 days.

(21) Appl. No.: 11/527,106

(22) Filed: Sep. 26, 2006

(65) Prior Publication Data

US 2007/0174953 A1 Aug. 2, 2007

Related U.S. Application Data

(63) Continuation-in-part of application No. 10/812,730, filed on Mar. 29, 2004.

(51) Int. Cl.
*A41D 13/00* (2006.01)

(52) U.S. Cl. ..... 2/466; 2/455; 2/467; 2/215

(58) Field of Classification Search ..... 2/466, 2/455, 228, 227, 214, 467, 69, 215, 79, 238
See application file for complete search history.

(56) References Cited

U.S. PATENT DOCUMENTS

| | | | | |
|---|---|---|---|---|
| 3,176,686 | A | 4/1965 | Barnes | |
| 4,451,083 | A | 5/1984 | Marchello | |
| 4,774,133 | A | 9/1988 | Doree | |
| 4,788,972 | A * | 12/1988 | DeBusk | 602/5 |
| 5,168,576 | A * | 12/1992 | Krent et al. | 2/456 |
| 5,271,101 | A * | 12/1993 | Speth et al. | 2/228 |
| 5,290,904 | A | 3/1994 | Colvin et al. | |
| 5,366,801 | A | 11/1994 | Bryant et al. | |
| 5,499,460 | A | 3/1996 | Bryant et al. | |
| 5,518,802 | A * | 5/1996 | Colvin et al. | 428/178 |
| 5,637,389 | A | 6/1997 | Colvin et al. | |
| 6,027,166 | A | 2/2000 | Yates | |
| 6,295,654 | B1 * | 10/2001 | Farrell | 2/456 |
| 6,393,618 | B2 | 5/2002 | Garneau | |
| 6,547,327 | B1 * | 4/2003 | Yates | 297/214 |
| 6,565,702 | B1 | 5/2003 | Forsyth et al. | |
| 6,687,917 | B2 * | 2/2004 | Forsyth et al. | 2/228 |
| 6,928,665 | B1 | 8/2005 | Yates | |
| 2001/0052146 | A1 | 12/2001 | Garneau | |
| 2002/0029409 | A1 * | 3/2002 | Coccia | 2/456 |
| 2003/0056282 | A1 * | 3/2003 | Coccia | 2/466 |
| 2003/0163076 | A1 | 8/2003 | Lukens | |
| 2004/0143890 | A1 | 7/2004 | Reschewitz | |
| 2005/0066423 | A1 | 3/2005 | Hogan | |
| 2005/0223478 | A1 | 10/2005 | Hogan | |

FOREIGN PATENT DOCUMENTS

| | | |
|---|---|---|
| EP | 0611330 | 1/1998 |
| WO | 9324241 | 12/1993 |

* cited by examiner

*Primary Examiner*—Gary L Welch
*Assistant Examiner*—Alissa J Tompkins
(74) *Attorney, Agent, or Firm*—Cantor Colburn LLP

(57) ABSTRACT

A seat pad for a cyclist garment, including a first side, an opposing second side, perforations formed through the seat pad so as to traverse from the first side to the second side and allowing passage of fluid therethrough, and at least one channel defined in the first side connecting together at least two of the perforations and being configured to direct fluid flow when the garment is worn.

18 Claims, 12 Drawing Sheets

SEAT PAD FOR CYCLIST GARMENT AND METHOD OF MANUFACTURE

CROSS REFERENCE TO RELATED APPLICATION

This application is a continuation-in-part of U.S. patent application Ser. No. 10/812,730 filed on 29 Mar. 2004, the entire contents of which are herein incorporated by reference.

TECHNICAL FIELD OF INVENTION

The invention generally concerns cycling equipment and, more particularly, a seat pad for a cyclist garment and a method of manufacturing the same.

DESCRIPTION OF RELATED ART

Increased popularity of cycling, at both recreational and competitive levels, has resulted in a demand for high quality, low cost cycling apparel which is effective at providing the user with bodily comfort during sustained periods of cycling.

Particularly, considerable attempts have been made at developing a pant which provides the cyclist with increased comfort concerning contact of the body with the cycle seat. Typically, during cycling, a substantial portion of the cyclist's body weight bears on the cycle seat. Additionally, when peddling the cyclist's body undergoes considerable movement relative to the cycle seat resulting in frictional contact therebetween. Such weight bearing and prolonged frictional contact are known to cause certain discomforts including minor abrasions and, in some instances, more serious injuries suffered at the lower abdomen area of the cyclist.

Existing cyclist pants include multi-layered seat pads affixed to the inside crotch area of the pants. Such seat pads are designed to increase comfort by providing a padded buffer between the cyclist and the cycle seat during use. However, such known seat pads are often bulky and result in the unintended consequence of adding to the cyclist's discomfort upon the cycle seat. Particularly, chafing of the cyclist is prone to occur, specifically in the upper thigh area. Also, increased pressure may result on areas such as the inner thigh and crotch regions as a result of the bulky seat pads. Further, such seat pads are known to be less flexible than desired, thus increasing discomfort of the cyclist. Additionally, these known seat pads do not provide suitable ventilation to the cyclist nor do they allow for drainage of fluids (e.g., perspiration, rainwater, etc.). Thus, heat and/or fluid may accumulate, further adding to the cyclist's overall discomfort.

Accordingly, a seat pad and a cyclist garment including the same are desired which provide effective padding against contact with the cycle seat, increased flexibility, and proper ventilation and drainage to the lower abdomen area of the cyclist.

BRIEF SUMMARY OF INVENTION

The above discussed and other problems and deficiencies of the prior art are overcome or alleviated by the invention which provides a novel and nonobvious seat pad device.

In one embodiment, the invention provides a seat pad for a cyclist garment, including a first side, an opposing second side, perforations formed through the seat pad so as to traverse from the first side to the second side and allowing passage of fluid therethrough, and at least one channel defined in the first side connecting together at least two of the perforations and being configured to direct fluid flow when the garment is worn.

The invention further provides a seat pad for a cyclist garment including a channel for directing a flow of fluid, where the channel is delimited by a plurality of perforations associated by hinge lines, each perforation including a hole extending through the seat pad.

The invention also provides a seat pad for a cyclist garment including aeration holes extending therethrough, each hole having a first port opening on a first surface of the seat pad and a second port opening on a second surface opposed to the first surface, the seat pad further including at least one recessed fluid escape channel defined on the first surface extending between at least two of the aerations holes and being in fluid communication with the first ports of the at least two aeration holes.

The above-discussed and other features and advantages of the apparatus and method of the invention will be appreciated and understood by those skilled in the art from the following drawings and detailed description.

BRIEF DESCRIPTION OF THE DRAWINGS

Referring now to the drawings wherein like elements are numbered alike in the several FIGURES.

DETAILED DESCRIPTION OF INVENTION

Figure 1:
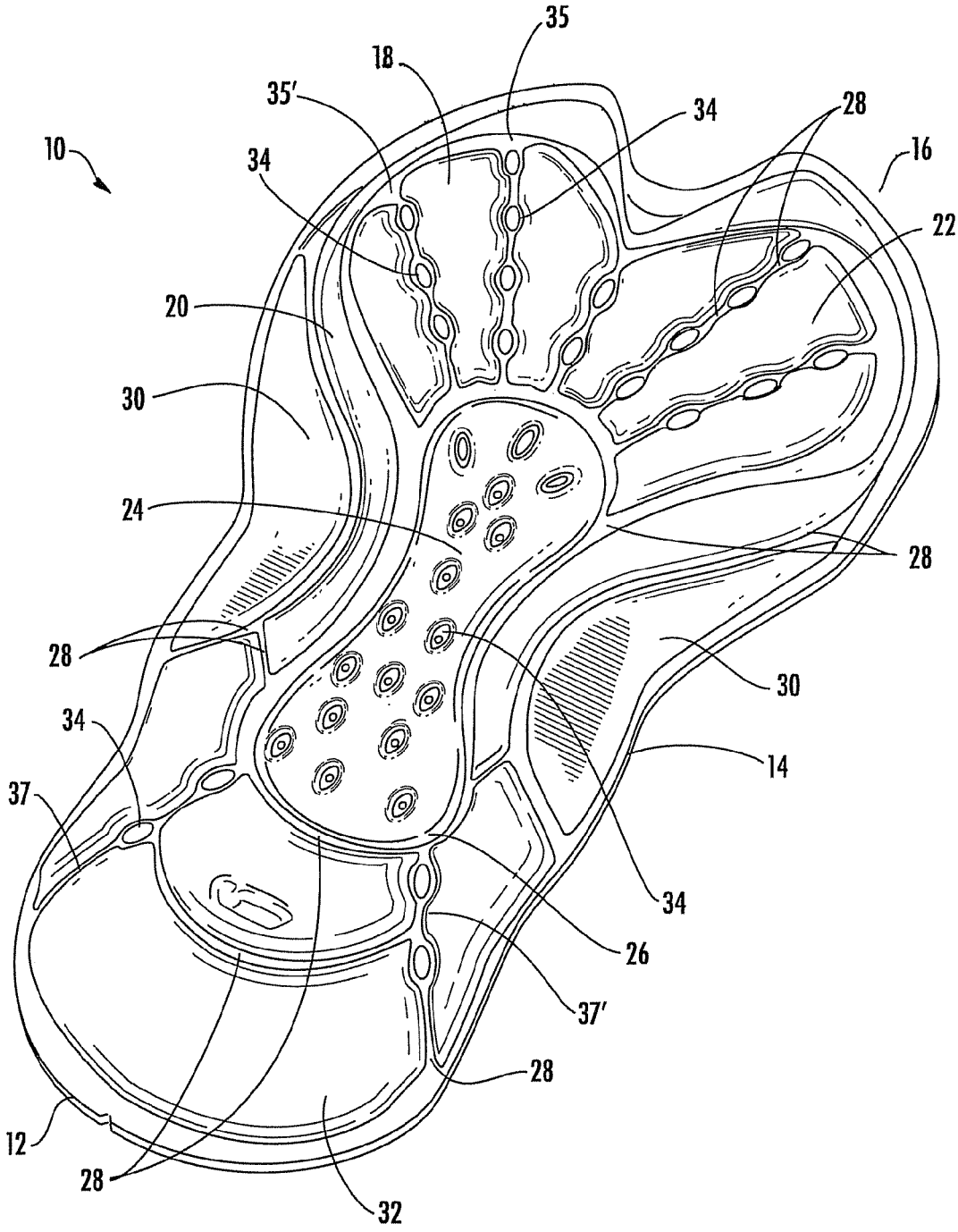
FIG. 1 is a perspective view of a cyclist seat pad, in one embodiment of the invention.

FIGS. 1-4 show various views of a cyclist seat pad 10, in one exemplary embodiment of the invention. The seat pad 10 is generally a padded substantially planar element intended to be disposed in a cycling garment for providing a male cyclist with enhanced comfort while sitting upon and riding a bicycle or the like.

The seat pad includes a front portion 12, an opposing rear portion 16, and an intermediate portion 14 disposed between the front and rear portions 12 and 16, respectively. The front portion 12 is generally U-shaped and is designed to contact and support the lower abdominal region of the cyclist. The rear portion 16 of the seat pad 10 is somewhat heart-shaped and is substantially wider than the front portion 12. The rear portion 16 is generally oriented to align with the buttocks region of the cyclist. The intermediate portion 14 serves to connect the front and rear portions 12 and 16, respectively, and includes curvilinear contouring along sides thereof. When the seat pad is properly utilized by the cyclist, the intermediate portion 14 contacts the crotch and upper thigh regions thereof.

A central padded area 18 is disposed centrally on the seat pad 10 about a longitudinal axis A-A. (See, FIG. 2.) The central padded area 18 extends from the rear portion 16, through the intermediate portion 14, towards the front portion 12. The seat pad 10 further includes an outer area 20 which extends substantially around a periphery of the central padded area 18. The central padded area 18 includes padding, as discussed further herein, and is substantially thicker than the outer area 20, as particularly evident in FIG. 3. The outer area 20 may include padding similar to that of the central padded area 18 or, alternatively, the outer area 20 may be relatively flat, or have differing degrees of padding.

The central padded area 18 includes a buttocks portions 22 disposed and designed for contact with the buttocks of the cyclist. The central padded area 18 further includes a crotch portion 24 extending centrally from the buttocks portions 22 along the axis A-A into the intermediate portion 14 of the seat pad 10. The crotch portion 24 is intended for contact with the crotch area of the cyclist, that is, the region generally between the legs. The central padded area 18 terminates toward the front portion 12 of the seat pad 10 at a perineum portion 26 particularly designed for contact with the perineum region of the cyclist.

Figure 3:
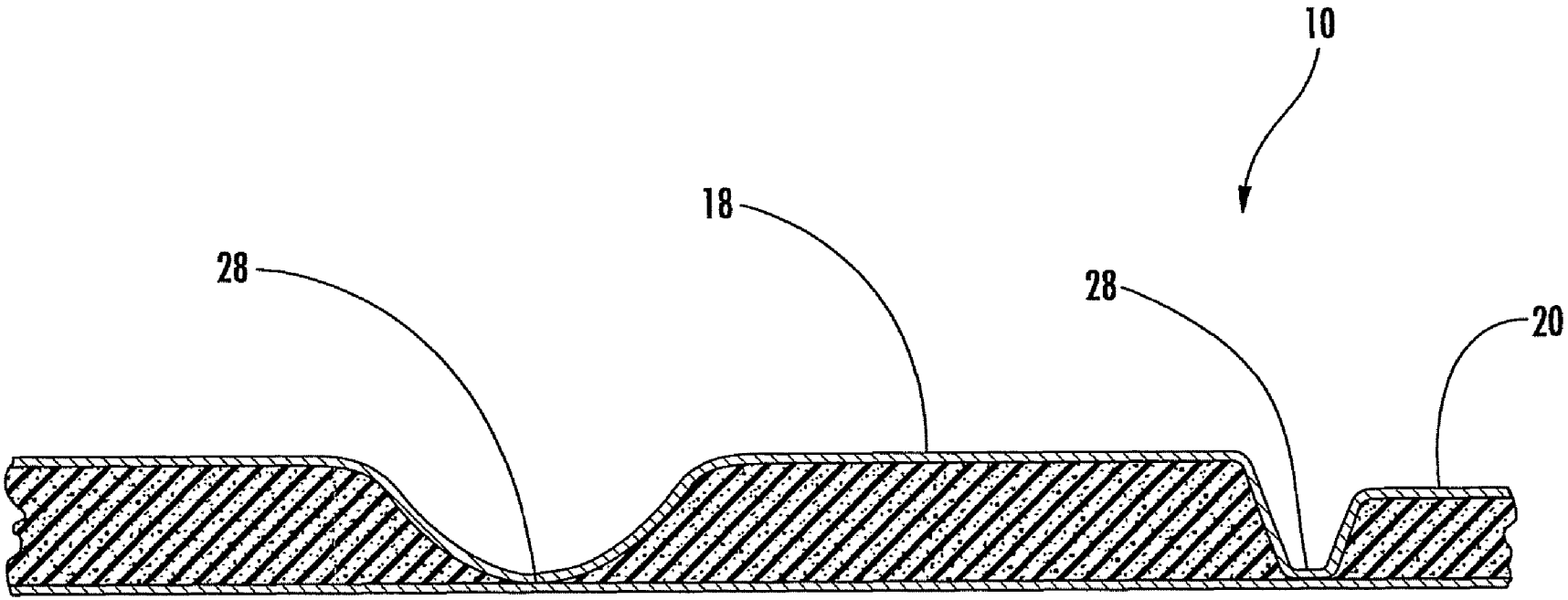
FIG. 3 is an enlarged partial cross-sectional view taken along line 3-3 of FIG. 2A.
Figure 4A:
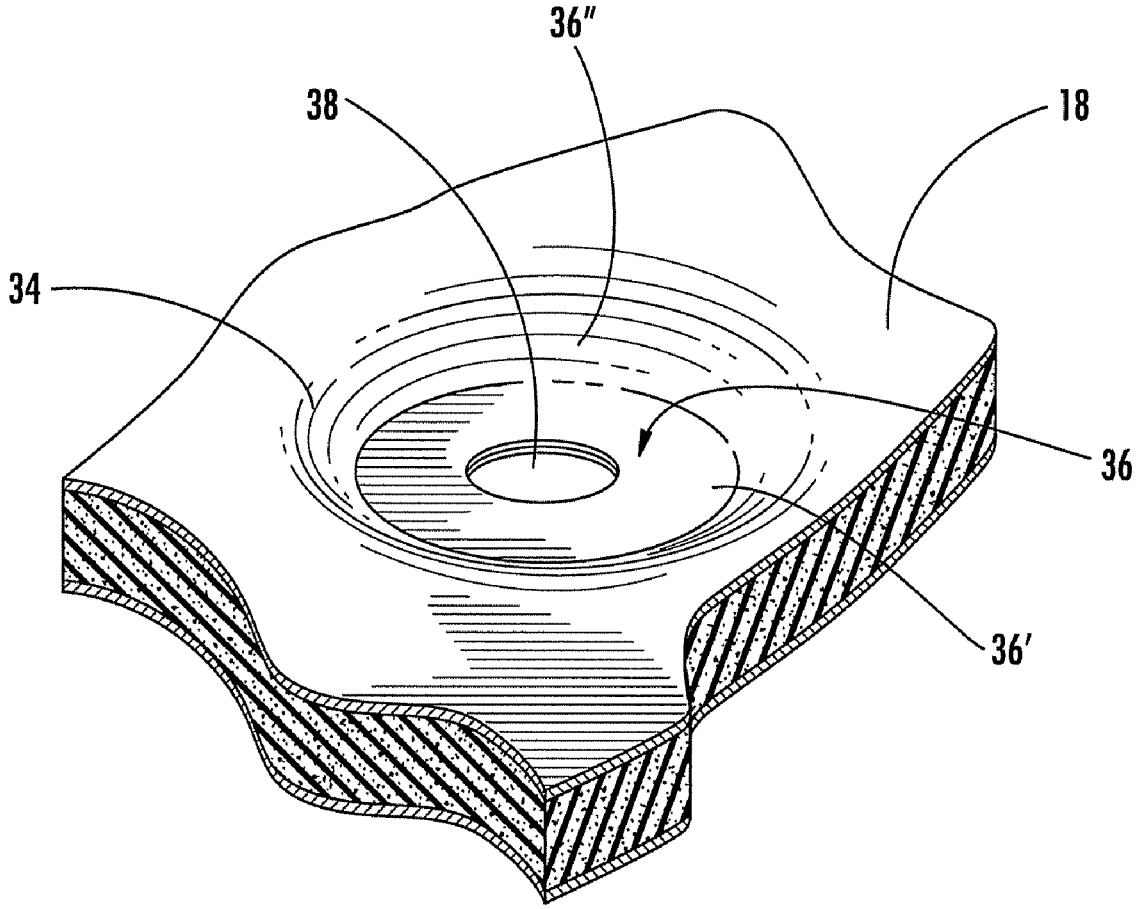
FIG. 4A is an enlarged perspective view of a portion of the cyclist seat pad of FIG. 1 showing a perforation thereof.
Figure 4B:
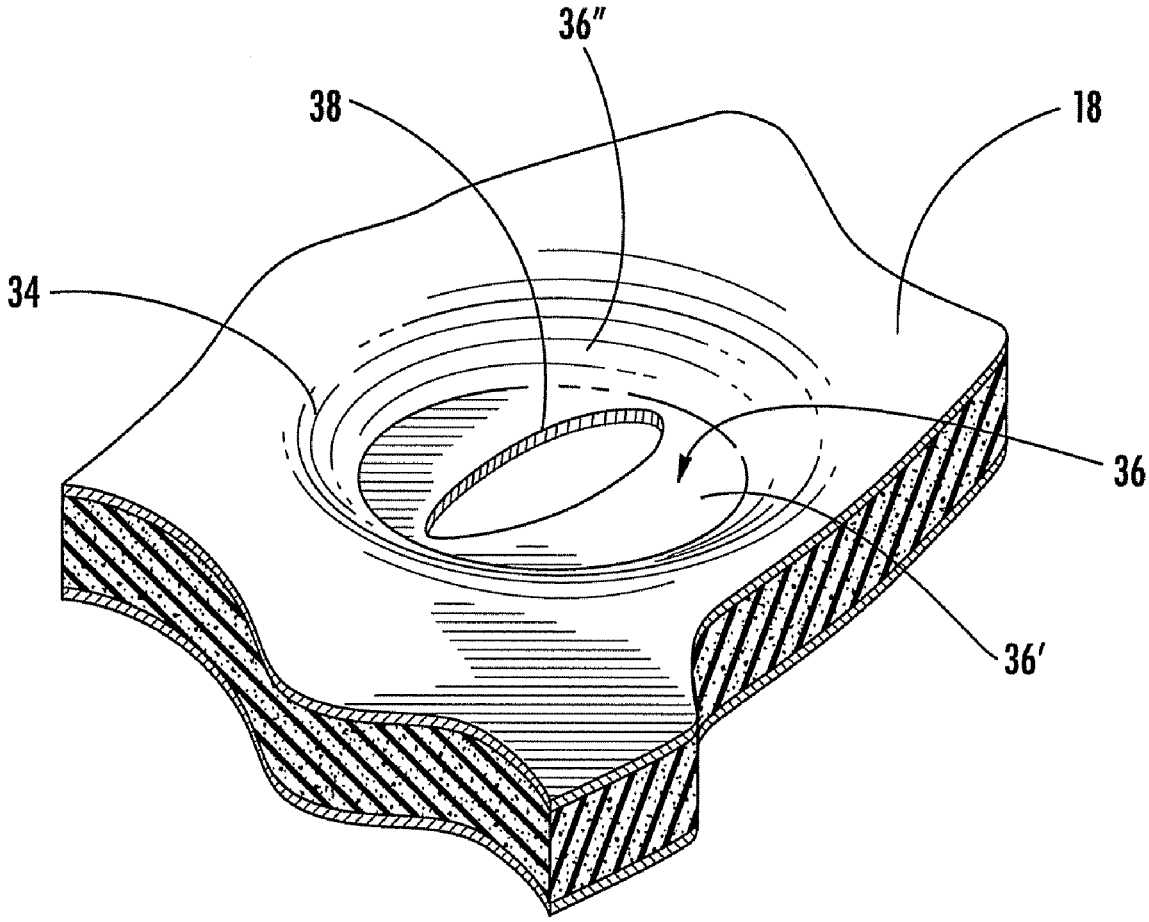
FIG. 4B is an enlarged perspective view of a portion of the cyclist seat pad of FIG. 1 showing a perforation thereof.

Thinned hinge lines 28 separate the buttocks portion 22 from the crotch and lower abdominal portions 24 and 26, respectively. The thinned hinge lines 28 are portions of the seat pad 10 having a reduced thickness, as best shown in FIG. 3. The thinned hinge lines 28 allow an area of the seat pad 10 to pivot, or otherwise move, relative to another portion. Additional thinned hinge lines 28 traverse a perimeter of the central padded area 18 separating the same from the outer area 20. Further thinned hinge lines 28 extend across the outer area 20.

The hinge lines 28 are formed by permanently compressing the central padded area 18 to obtain the desired reduced thickness thereof. The compression is achieved by heat treatment or by a high frequency fusion treatment.

While the thinned hinged lines 28 are described herein and throughout with regard to specific dispositions thereof on the seat pad 10, this is in no way intended to limit the scope of the formation and the positioning of the hinge lines 28. As mentioned, such lines 28 provide the seat pad with an advantageous degree of flexibility. Accordingly, the thinned hinge lines 28 may be disposed at any position on the seat pad 10 as desired to provide enhanced flexibility thereto and/or to bring any additional advantages thereof to the seat pad of the invention.

The outer area 20 extends around the central padded area 18, as mentioned, and includes upper thigh portions 30 disposed generally at the intermediate portion 14 of the seat pad 10, adjacent the crotch portion 24 of the central padded area 18. The upper thigh portions 30 are intended for contact with the upper thigh areas of the cyclist. A lower abdominal portion 32 of the outer area 20 extends toward the front 12 of the seat pad 10. The lower abdominal portion 32 of the outer area 20 combines with the perineum portion 26 of the central padded area 18 to provide additional support and padding to the male cyclist's lower abdominal area.

Thinned hinge lines 28 extend along the upper thigh portions 30 and between said portions and the lower abdominal portion 32 to provide increased flexibility and added comfort.

The seat pad 10 further includes a plurality of perforations 34 formed, for example, in the central padded area 18. The perforations 34 extend entirely through the seat pad 10 to provide ventilation to the central padded area 18 during use of the seat pad 10. Such ventilation allows airflow to move from the cyclist's side of the seat pad 10 to an opposite outer side and vice versa. This airflow cools the cyclist and allows for fluid evaporation to thus keep the cyclist dry for enhanced comfort. Furthermore, the perforations are sized and disposed to allow for the passage of fluid. That is, perspiration, rainwater, etc., which has accumulated on the seat pad 10 against the cyclist's body is permitted to drain from the cyclist's side of the pad 10 to the outer, exterior side. The seat pad 10 is typically disposed in a cycling pant formed of a moisture wicking material. Thus, the fluid which drains through the perforations 34 to the outer side of the pad 10 is promptly wicked to an exterior of the pant away from the cyclist's body. This provides enhanced comfort and dryness. Additionally, the perforations 34 reduce the overall weight and size of the seat pad 10 and provide increased flexibility thereof, thus enhancing comfort to the cyclist.

Each of the plurality of perforations 34 includes a recess 36 which comprises a substantially curvilinear portion of the central padded area 18 having a reduced thickness. See FIGS. 1-3 and, particularly, FIGS. 4A-B. That is, the recess 36 includes a generally planar surface 36' of a reduced thickness relative to the remainder of the central padded area 18. The recess 36 further comprises sloping walls 36" which descend from the surrounding portion of the padded area 18 to the planar surface 36'.

Each perforation 34 further includes a hole 38 formed at the recess 36 and extending entirely through the seat pad 10. The recesses 36 are larger than the corresponding holes 38. Thus, the holes 38 are resultantly seated at the substantially planar surface 36' of the recesses 36, such that the holes 38 are surrounded by a portion of the reduced thickness part of the central padded area 18 which forms the recess 36. That is, the holes 38 are essentially inset into the central padded area 18 and surrounded by a reduced thickness portion of the central padded area 18.

The recesses 36 are formed by permanently compressing the central padded area 18 to obtain the desired reduced thickness thereof. The compression is achieved by heat treatment or by a high frequency fusion treatment. The holes 38 are then cut, for example, die punched through the reduced thickness portion of the central padded area 18 at the recesses 36.

The recesses 36 may be formed on an interior surface of the seat pad 10 so as to contact the body of the cyclist. The holes 38, as described, are inset into theses recesses 34. Additional recesses may be formed on the outer, opposite side of the seat pad 12, that is, the side of the seat pad which is affixed to the garment. The recesses on this outer side are formed so as to correspond with the recesses of the upper surface such that the respective holes traverse from a recess at the interior surface through the seat pad to a recess at the outer surface.

The inset configuration of the holes 38 is advantageous in several respects. Firstly, the permanently compressed nature of the recesses 36 expedite formation of the holes 38 through the seat pad 10. That is, the holes 38 may be easily and consistently punched through the compressed first pad area 18 at the recesses 36 without encountering difficulties inherent in punching or cutting the non-compressed, fully formed, thick padded material prevalent at the central padded area 18. Secondly, the compressed central padded area 18 resists tearing proximate the holes 38 during formation thereof and during subsequent use of the seat pad 10 by the cyclist.

Additionally, the inset feature of the holes 38 serves to prevent blockage thereof during use of the seat pad 10. As noted above, a particular recess 36 is larger in area than the corresponding hole 38. Thus, due to the larger size of the recesses 36, the cyclist's body may contact a portion of one of the recesses 36 while another portion of the same recess 36 remains open, thus providing a direct pathway to the corresponding hole 38 for ventilation. Even if, during use of the seat pad 10, the cyclist's body fully contacts and entirely covers a recess 36, the material of the central padded area 18 may serve to support the cyclist above the particular hole 38. That is, while the recess 36 may be covered, the corresponding hole 38 remains open and capable of allowing ventilation of an interior of the recess 36 and of a region of the central padded area 18 proximate the recess 36.

Further embodiments of the invention contemplate the perforations 34 as formed on only a portion of the central padded area 18. For example, the perforations may be formed on only the buttocks portion 22 of the padded area 18, or only on the crotch portion 24 of the area 18. Additionally and/or alternatively to the embodiments of the seat pad 10 thus far disclosed, the perforations 34 may be formed on at least a portion of the outer area 20 as shown. For example, the perforations 34 may be formed on the upper thigh portions 30 of the outer area 20 and/or on the lower abdominal portion 32 thereof, etc. The perforations 34, if any, formed in the outer area 20 include the recesses 36 comprising permanently compressed, reduced thickness areas of the outer area 20 having holes 38 formed therein, similar to that described above with reference to the central padded area 18. Alternatively, the perforations 34 may be formed directly in the outer area 20 without establishing a permanently compressed portion thereof.

The perforations 34 may be disposed regularly across the surface of the central padded area 18 and/or the outer area 20. Alternatively, the perforations may be disposed randomly or in predetermined concentrated groupings across the central padded area 18 and/or the outer portion 20.

In the present exemplary embodiment of the seat pad 10, the central padded area 18 includes perforations 34 disposed in both the buttocks portion 22 and in the crotch portion 24. The perforations 34 located in the crotch portion 24 include recesses 36 of substantially circular shape and having a diameter of approximately four to seven millimeters. The respective holes 38 are also generally circular in shape and include a diameter of approximately one to three millimeters. These circular perforations 34 disposed in the crotch portion 24 of the central padded area 18 include a recess depth of approximately eight to ten millimeters. Generally, the recess depth is defined as a distance from an uncompressed area of the seat pad 10 to the permanently compressed planar surface 36' of the recess 36. Perforations 34 which may be disposed in the outer area 20 of the seat pad 10 include a recess depth of approximately five to seven millimeters.

The perforations 34 disposed in the buttocks portion 22 of the padded area 18 are generally oval in shape, as shown in FIGS. 1-4. That is, the holes 38 are substantially oval shaped and the recesses 36 are correspondingly oval shaped. The oval recesses 36 have a length along a major axis of approximately five to thirty millimeters. The oval recesses 36 further have a length of a minor axis of approximately three to twenty millimeters. These oval perforations 34 disposed in the buttocks portion 22 include a recess depth of approximately five to ten millimeters.

The oval perforations 34 are also formed in the crotch portion 24 of the central padded area 18 in an area of the crotch portion 24 which is proximate to the buttocks portion 22. As shown in the drawings, at least one oval perforation 34 is formed in the crotch portion 24 adjacent to the buttocks portion 22. Here, in this example, there are three oval perforations 34 arranged in the crotch portion 24 proximate to the buttocks portion 22.

Buttocks portion 22 of the central padded area 18 includes the hinge lines 28 disposed so as to connect the respective oval perforations 34. In this way, the planar surface 36', in which the oval hole 38 is formed, is essentially continuous from one adjacent perforation 34 to another. Thus, a channel 35 is delimited which traverses the buttocks portion 22 of the central padded area 18. This channel 35 comprises a region of reduced thickness formed within the central padded area 18 and extending at least partially there across. In this exemplary embodiment, a plurality of oval perforations 34 are disposed in a generally linear alignment in the padded area 18. For example, the major axes of the oval perforations 34 are aligned along an axis B-B. See, FIG. 2B. The axis B-B extends across the buttocks portion 22 of the central padded area 18, generally from the rear portion 16 of the seat pad 10 in a direction toward the crotch portion 24 of the padded area 18. A plurality of the oval perforations 34 are disposed along the axis B-B and are connected by the hinge lines 28 to thus delimit the channel 35. The axis B-B is generally disposed at an angle of approximately 20 degrees relative to the longitudinal axis A-A of the seat pad 10. An additional plurality of oval perforations 34 are disposed in linear fashion adjacent to the channel 35 and toward an outer edge of the central padded area 18. These oval perforations 34 are connected via hinge lines 28 in order to form a channel 35' similar in nature and orientation to the channel 35. That is, the channel 35' extends substantially linearly across the buttocks portion 22 of the padded area 18 from the rear 16 of the seat pad 10 toward the crotch portion 24 of the padded area 18. The channel 35' is disposed at an angle of approximately 40 degrees relative to the longitudinal axis A-A of the seat pad 10.

Figure 2A:
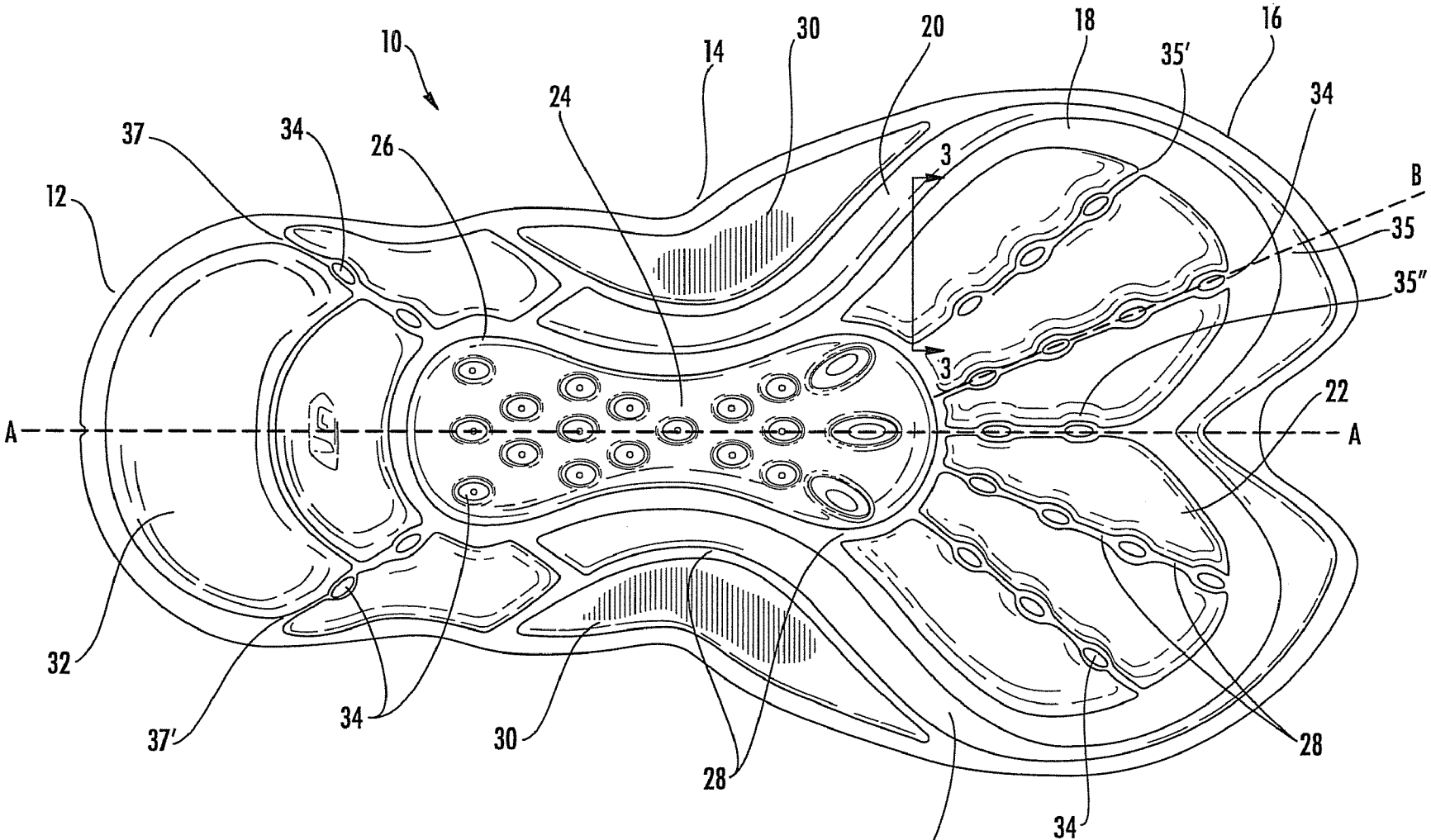
FIG. 2A is a top plan view thereof.
Figure 2B:
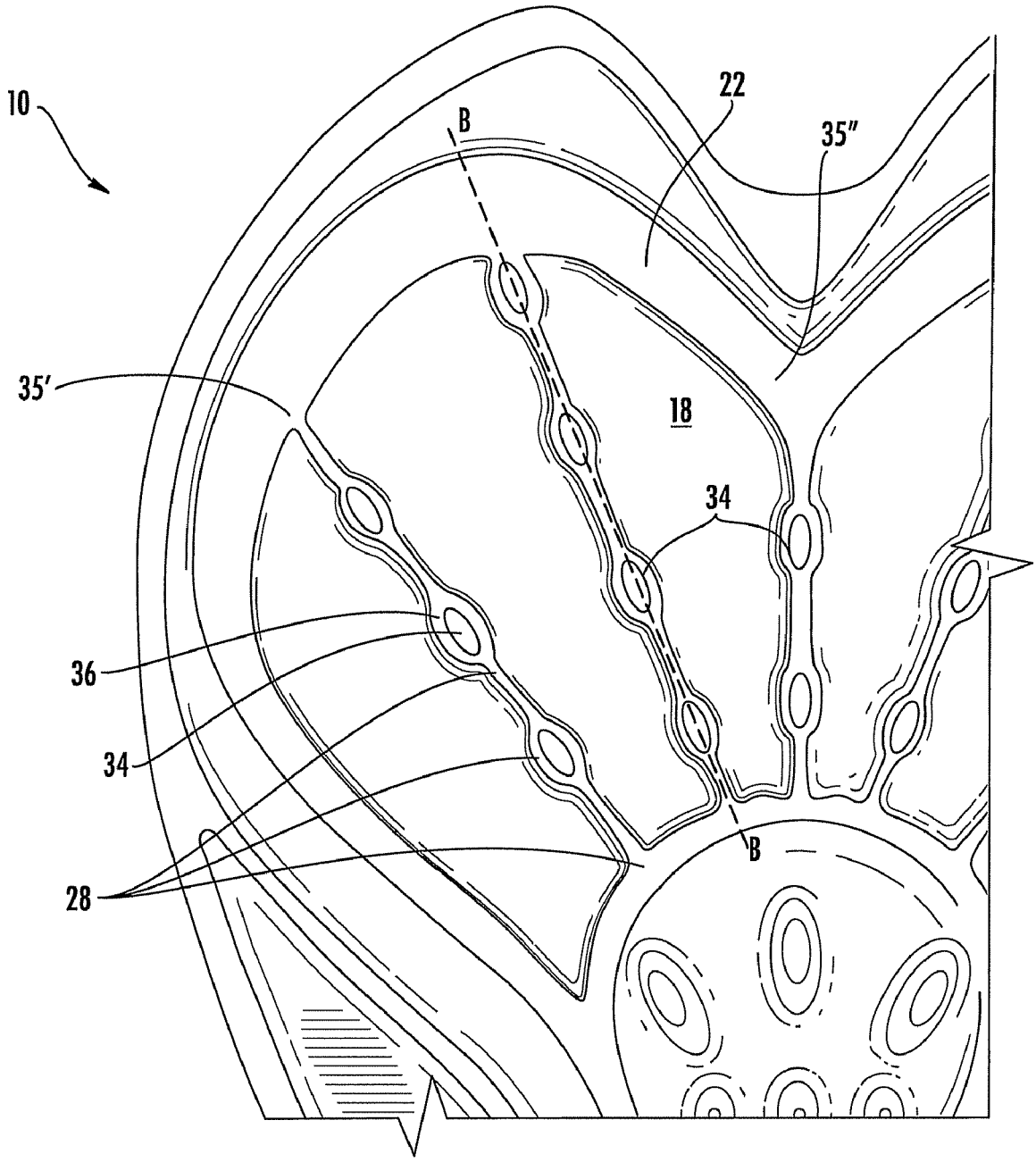
FIG. 2B is an enlarged view of a portion of FIG. 2A.

The opposite side of the buttocks portion 22 from that shown in FIG. 2B includes channels mirroring the channels 35 and 35' discussed above. That is, this opposite side of the buttocks portion 22 includes a plurality of oval perforations 34 and hinge lines 28 forming a first channel 35 extending substantially linearly at approximately 20 degrees relative to the axis A-A and a second channel 35' disposed toward an outer side of the padded area 18 and extending substantially linearly at an angle of approximately 40 degrees relative to the axis A-A.

An additional plurality of oval perforations 34 and corresponding hinge lines 28 are disposed along the axis A-A so as to form another channel 35". Accordingly, in this example, the buttocks portion 22 of the central padded area 18 includes a total of five channels, each formed by a plurality of oval perforations 34 and a corresponding plurality of thinned hinge lines 28. The channels have a depth equivalent to the depth of the perforations 34, i.e., the channels have a depth of approximately five to ten millimeters. At the crotch portion 24 of the central padded area 18, the various channels of the buttocks portion 22 intersect a hinge line 28 which divides the buttocks and crotch portions 22 and 24.

As discussed above with regard to the circular perforations 34 of the crotch portion 24, the oval perforations 34 of the buttocks portion 22 of the padded area 18 permit cooling and drying ventilation air to flow through the seat pad 10 from an interior side adjacent to the cyclist's body to an outer side away from the cyclist. Additionally, the channels 35, 35', and 35" formed in the buttocks portion 22 allow this air to flow between the various oval perforations 34. Also, the channels allow this ventilation air to flow from the rear 16 of the seat pad 10, across the various oval perforations 34, and to the hinge line 28 dividing the buttocks and crotch portions 22 and 24. This air, of course also may move in the opposite direction. In this way, an increased volume of air may pass through the seat pad 10 and enter the inner side thereof during use of the pad 10 by the cyclist. Correspondingly, a greater surface area of the cyclist's body is exposed to this ventilating air. The result is an increased cooling and drying of the cyclist's body in the area of the buttocks portion 22 of the seat pad 10, thus providing enhanced comfort.

The channels 35, 35', and 35" further serve to collect fluid on the inner side of the seat pad 10 and to direct such fluid to the perforations at which the fluid may drain to the outer side of the seat pad 10. Fluid, such as perspiration, rain water, etc., which is located on the inner side of the seat pad 10 in the vicinity of the channels 35, 35', and 35" may readily flow into the recesses 36 surrounding the oval perforations 34 and or into the hinge lines 28 extending between the perforations 34. Then the fluid may move to the respective oval holes 38 and can pass there through to the outer side of the seat pad 10. Similarly, fluid may flow to or from the hinge line 28 separating the buttocks and crotch portions 22, 24 of the padded area. This fluid may then drain into the channels 35, 35', 35" and through the oval holes 38 to the outer side of the seat pad 10. Alternatively, this collected fluid may run through the hinge line 28 between the buttocks and crotch portions 22, 24 and drain at the upper thigh portions 30.

The linear disposition of the channels 35, 35', and 35" allows for increased flexibility of the buttocks portion 22 of the seat pad 10. That is, each channel 35, 35', and 35" acts as an axis about which the seat pad 10 may rotate. For example, the channel 35" located in the center of the buttocks portion 22 along the axis A-A, allows the left side (see, FIG. 2B) of the buttocks portion 22 to rotate about the axis A-A relative to the opposite right side of the buttocks portion 22. That is, the channel 35" serves as a central hinge permitting the seat pad to fold and hinge upon itself. The channels 35 and 35' perform similarly in allowing certain areas of the seat pad 10 to rotate about the respective channel 35, 35' relative to other areas of the seat pad 10.

The seat pad 10 further includes channels 37 and 37' formed in the outer portion 20 of the seat pad 10. Particularly, the channels 37 and 37' are disposed in the lower abdominal portion 32 and extend from the perineum portion 26 of the padded area 18 to the front 12 of the seat pad 10. Each of the channels 37 and 37' include one or more perforations 34. Particularly, the each of the channels 37, 37' include at least two oval perforations 34 connected by hinge lines 28. The hinge lines 28 further extend from the oval perforations 34 to the padded area 18 and to the front 12 of the seat pad 10. Similar to the channels 35, 35', 35", the channels 37 and 37' provided increased flexibility of the seat pad 10 and allow for enhanced ventilation air flow and fluid evacuation.

The channels 35, 35', and 35" are described above as extending in a generally linear fashion from the rear 16 of the seat pad, across the buttocks portion 22 of the central padded area 18, and terminating at the hinge line 28 which separates the buttocks and crotch portions 22, 24. Similarly, the channels 37 and 37' are described as being disposed in a linear arrangement, extending from the perineum portion 26 of the central padded area 18 to the end 16 of the seat pad 10. These configurations are merely exemplary of the broad scope of the invention. The seat pad 10 may include any number of channels extending in a linear and/or non-linear manner across the buttock portion 22, the crotch portion 24, the perineum portion 26 and/or the outer portion 20. The channels of the invention may include the oval perforations 34 as described immediately above, and/or the circular perforations 34 discussed previously with regard to the crotch and perineum portions 24, 26 of the padded area 18, and/or any curvilinear perforation, and/or any rectilinear perforation, and any combination thereof. Additionally, the channels may extend continuously between any combination of the buttocks portion 22, the crotch portion 24, the perineum portion 26, and the outer portion 20.

The various channels 35, 35', 35", 37, 37' are described herein as including the perforations 34. Alternatively, however, some or all of the channels of the seat pad of the invention may include no perforations. Thus, rather than facilitating inflow and outflow of air and/or fluid, these channels are intended simply to direct flow of the air and/or fluid along a length of the channel.

Figure 5:
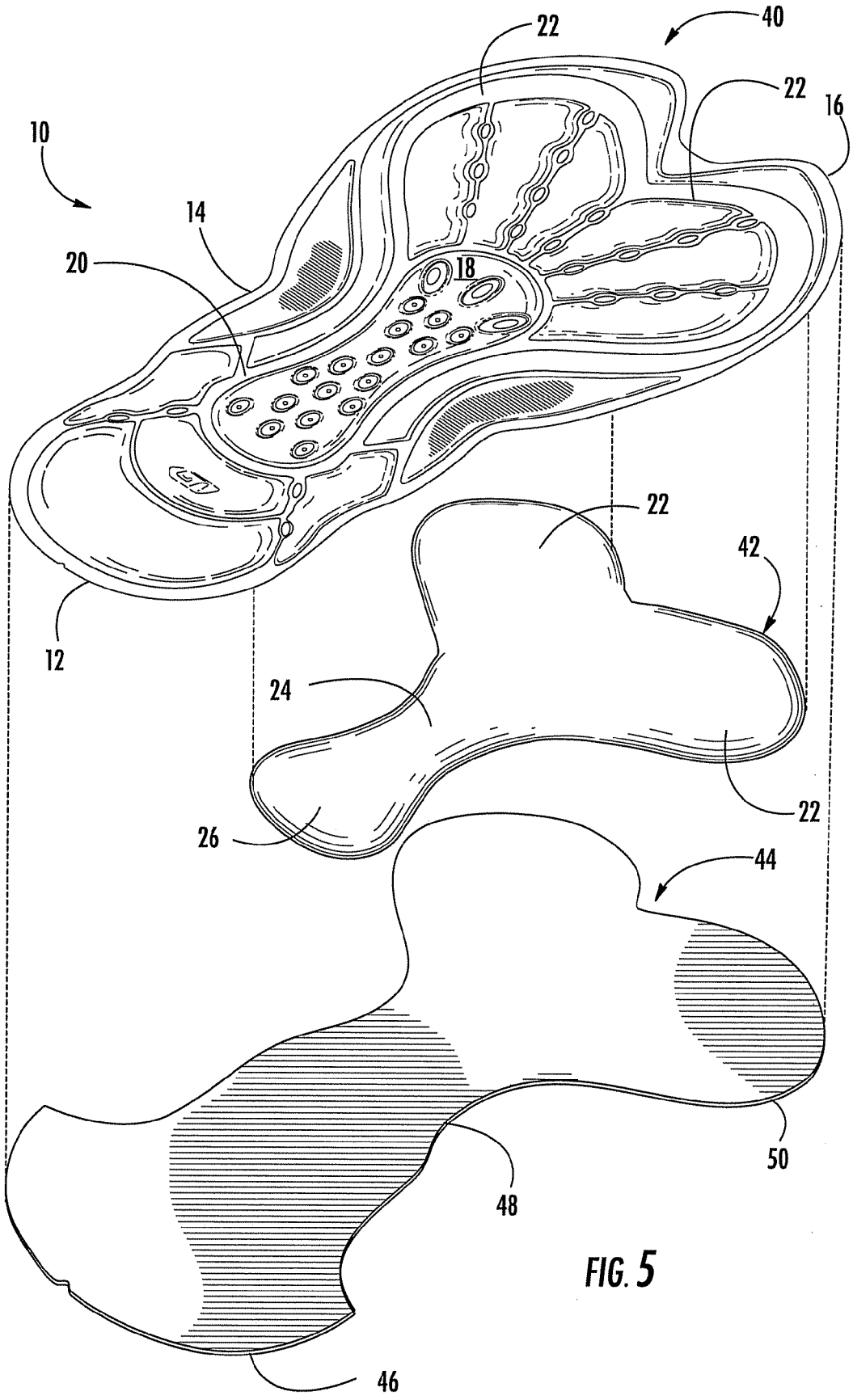
FIG. 5 is a perspective, exploded view of the cyclist seat pad of FIG. 1 showing the multiple layers thereof.

In one embodiment, the seat pad 10 is a multi-layered element. FIG. 5 shows an exploded perspective view of the seat pad 10 revealing the various layers. As shown therein, the seat pad includes an inner layer 40, a middle layer 42, and an outer layer 44. The inner layer 40 contacts the body of the cyclist during use of the seat pad 10, the outer layer 44 is fixed to a cycling garment opposite the body of the cyclist, and the middle layer 42 is disposed between the inner and outer layers 40 and 44, respectively.

While various individual layers of the seat pad 10 are herein specified, this description is only exemplary and is not intended to limit or otherwise narrow the invention. The seat pad may include any number of layers in any potential combination thereof as desired for achieving the comfort properties and padding provided by the seat pad. Further, it shall be understood that the layers composing the seat pad may individually be formed of a uniform, monolithic material construction or, alternatively, such layers may themselves be composed of a plurality of material layers. Thus when describing and reciting "a layer" of the seat pad herein, any of these constructions are contemplated, as well as combinations and variations thereof.

The inner layer 40 is composed of a cloth-like material. That is, the inner layer comprises a thin, generally non-compressible, woven fibrous material formed of, for example, a polyester such as a brushed micro-fiber polyester. The inner layer comprises a thickness of approximately 0.2 to 4.0 millimeters and, in another embodiment, approximately 0.3 to 2.0 millimeters. In one embodiment, the inner layer 40 further includes an antibacterial finish disposed on or in the surface of the layer 40 which contacts the body of the cyclist.

The middle layer 42 is composed of a thick compressibly resilient open-cell foam, such as polyurethane or another "air breathing" material. The middle layer 42 includes a thickness of approximately ten to fifteen millimeters, and in another embodiment, approximately twelve millimeters.

Figure 6:
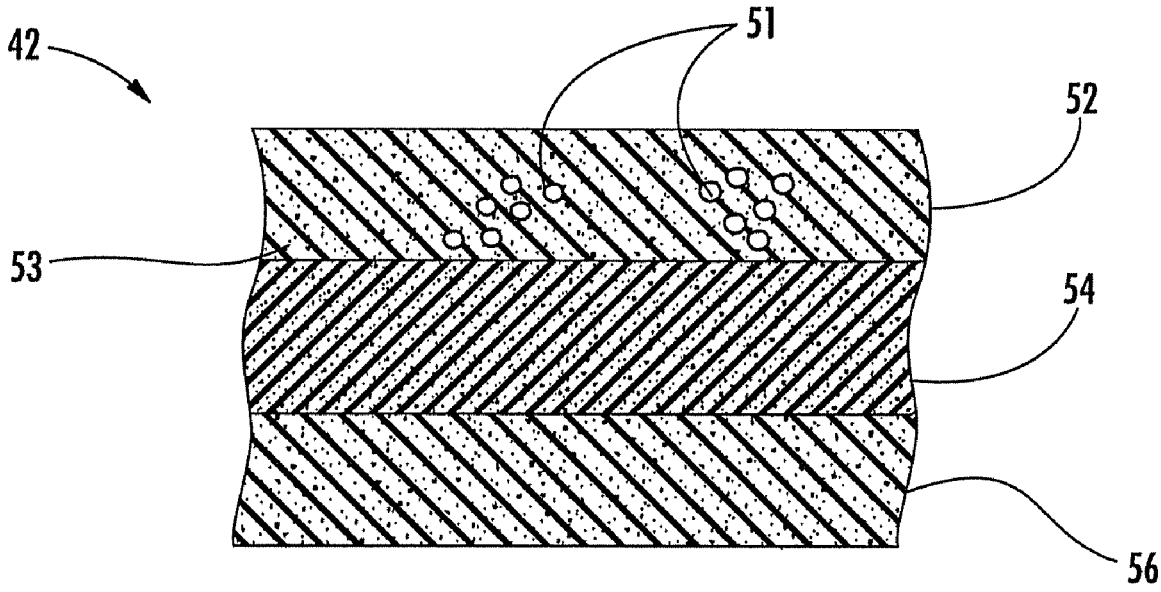
FIG. 6 is an enlarged, partial cross-sectional view of one of the layers shown in FIG. 5.

In the embodiment of the seat pad 10, as shown in FIG. 6, the foam padding material composing the middle layer 42 comprises a plurality of layers. Specifically, the middle layer 42 includes a first layer 52 disposed at an upper side of the layer 52 proximate the inner layer 40. The first layer 52 comprises a padding material, such as a foam, which is designed to readily absorb and release heat from the body of the cyclist as desired and provide antibacterial protection to the cyclist.

In another embodiment, the first layer 52 comprises a thermal control material having thermal energy storage and insulative properties for use as a thermal barrier between a heat source and a heat sink. The thermal control material of the first layer 52 comprises a foam base 53 forming an insulative pad and a plurality of microcapsules 51 dispersed throughout the foam base 53 containing a phase change material. The foam base material 53 comprises any suitable, open or closed cell, moldable foam such as foamed organic plastic, etc. The microcapsules 51 may be composed of a plastic and the phase change material contained therein comprises, for example, eicosane, plastic crystals (e.g., 2,2-dimethyl-1,3-propanediol

[DMP]), paraffinic hydrocarbons, etc. For example, the first layer 52 may comprise a material commercially available under the U.S. Registered Trademark, "Comfortemp DCC" and/or as described in U.S. Pat. Nos. 5,290,904, 5,366,801, 5,499,460, 5,637,389 and/or European Patent No. EP 0611330, and/or International Patent Application No. PCT/US93/05119, all of which said patents and applications are incorporated herein by reference in their entirety.

The first layer 52 generally includes a thickness of approximately less than ten millimeters. In another embodiment, the thickness of the first layer 52 is approximately four millimeters. These thickness, or course, are merely exemplary, and refer generally to the present illustrative embodiment of the first layer 52. The thickness of the first layer 52 may be greater or less than these approximations and, further, may vary across the first layer 52, i.e., various portions of the layer 52 may include different thicknesses. Moreover, the amount of thermal control material provided in the first layer 52 may be varied throughout the layer as desired. Additionally, while the first layer 52 is herein described as a generally homogenous single layer, the invention contemplates the first layer 52 comprising a plurality of sub-layers. For example, the first layer 52 may comprise two or more sub-layers of the above-described thermal control material. Also, the first layer 52 may only comprise a simple foam for providing padding to the cyclist, or the layer 52 may only comprise the discussed thermal control material, or the layer 52 may comprise both the simple foam and the thermal control material without any limitation of quantity, thickness, etc. of either product.

The middle layer 42 further comprises a second layer 54 disposed on an underside of the first layer 52, that is, opposite the inner layer 40. The second layer 54 is composed of a resilient, compressible foam designed to provide the cyclist with both padding comfort and support. The foam of the second layer 54 is composed, for example, of a Polyurethane expanded polyester base having a density of about 20.0 and a thickness of approximately less than ten millimeters. In another embodiment, the thickness of the second layer 54 is approximately five millimeters. It is herein noted that the middle layer 54 is described above and shown in FIG. 8 as being disposed at the underside of the first layer 52. This, of course, is only an exemplary configuration of the middle layer 42. The invention contemplates the second layer 54 being disposed atop the first layer 52 or in any other desirable position relative the first layer 52.

The middle layer 42 additionally includes a third layer 56 disposed beneath the second layer 54 proximate the outer layer 44. The third layer 56 is composed of a resilient, compressible foam designed to provide the cyclist with padding comfort, support, and moisture absorption. The foam of the third layer 56 is composed of a Polyurethane expanded polyester base having a density of about 90 and a thickness of approximately less than ten millimeters. In another embodiment, the thickness of the third layer 56 is approximately three millimeters.

The various first, second, and third layers 52, 54, and 56 are fused or bonded or otherwise adhered together to form the middle layer 42 of the seat pad 10. Returning to FIG. 5, the middle layer 42 includes a shape which corresponds substantially to the central padded area 18, described above. That is, the middle layer 42 includes the buttocks portions 22, the crotch portion 24, and the perineum portion 26 described above with reference to FIGS. 1-4. The middle layer 42, however, is substantially smaller than the inner layer 40 and, as discussed, includes a different shape than that of the inner layer 40. That is, the middle later 42 does not complement the inner layer 40.

This being said, the invention contemplates embodiments wherein one or several of the first, second, and third layers 52, 54, 56 of the middle layer 42 extend beyond the limits of the central area 18 of the inner layer 40. For example, the first layer 52 may extend so as to overlap the outer area 20, partially or entirely, when the middle layer 42 is fixed together with the inner layer 40.

The outer layer 44 is composed of a cloth-like material. That is, the outer layer 44 comprises a thin, generally non-compressible, woven fibrous material formed of a synthetic polymer, such as a polyamide, for example a nylon. The outer layer 44 comprises a thickness of approximately 0.2 to 2.0 millimeters and, in another embodiment, approximately 0.3 to 1.0 millimeters.

The outer layer 44 is smaller in area than the inner layer 40, but is generally larger than the middle layer 42. For example, the outer layer 44 may include a total surface area that is between fifty and ninety percent of a total surface area of the inner layer 40. Further, the surface area of the outer layer 44 may be between sixty and eighty percent of the total surface area of the inner layer 40. Still further, the outer layer 44 surface area may be seventy to eighty percent of the inner layer 40 surface area. Moreover, the surface area of the outer layer 44 may be approximately seventy-five percent of the surface area of the inner layer 40.

Additionally, the outer layer 44 includes an elongated shape different from the shapes of both the inner and middle layers 40 and 42, respectively. Thus, the outer layer 44 does not complement the inner layer 40 nor the middle layer 42. See particularly, FIGS. 7 and 9*a*. Specifically, the outer layer 44 includes a first end 46 and an opposing second end 50. The outer layer 44 tapers inward slightly at a neck portion 48 giving the outer layer 44 a substantially hourglass-like shape.

In one embodiment, the first end 46 of the outer layer 44 extends toward and meets the edge of the front portion 12 of the seat pad 10. However, in another embodiment, the first end 46 of the outer layer terminates short of, and does not meet, the edge of the front portion 12.

It is particularly noted that the outer layer 44 possesses a somewhat hourglass-like shaped, as mentioned above. This shape is provided by the wider first end 46, the even wider opposing second end 50, and the more narrow neck portion 48 disposed therebetween. The neck portion 48 substantially corresponds to the crotch and perineum portions 24, 26 of the central area 18 described hereinabove. That is, the neck portion 48 (as well as the first and second ends 46, 50) does not extend into the region of the pad 10 defined as the upper thigh portions 30 of the outer area 20, discussed hereinabove. The resulting pad 10 includes thin upper thigh portions 30 thus reducing bulkiness and enhancing comfort.

The inner layer 40, the middle layer 42, and the outer layer 44 are fixed together to form the multi-layered seat pad 10. The various layers 40, 42, 44 are fixed together in any sufficient manner which establishes a lasting bond therebetween. For example, the layers may be temperature bonded, high frequency fusion bonded, affixed together by use of an ultrasound gun, adhered together with an adhesive such as a glue, etc. During this bonding process the materials of the various layers may be compressed or otherwise made smaller as desired to achieve a final seat pad 10 a specific thickness. For example, inner, middle, and outer layers 40, 42, and 44 having original thicknesses of one millimeter, twelve millimeters, and one millimeters, respectively, may be compressed or reduced to form into the seat pad 10 having a maximum thickness of approximately ten millimeters or less.

The seat pad 10 fabricated as discussed above, includes a plurality regions having distinct thicknesses due to overlapping or non-overlapping of the inner, middle, and outer layers 40, 42, and 44. That is, due to the varying shapes and sizes of the layers composing the seat pad 10, some areas of the pad 10 include all three layers overlapped and thus include a maximum thickness, while other areas of the pad do not include all of the layers overlapped upon each other and thus these areas include a reduced thickness.

The portion of the pad 10 indicated by the central region 18 comprises all three inner, middle, and outer layers 40, 42, and 44 laminated together as discussed herein. The central region 18 generally includes a thickness of approximately five to fifteen millimeters. The buttocks portion 22 of the central region 18 includes a thickness of approximately ten millimeters and the crotch and perineum portions 24, 26 include a thickness of approximately eight millimeters. The materials composing this region of the pad (the properties of which are discussed above), and the construction thereof, provide the cyclist with sufficient support, enhanced padding against shock and impact, increased flexibility, temperature control, and moisture absorption and evacuation.

A substantial portion of the weight of the cyclist bears on the cycle seat at the central area 18, thus enhanced support and padding is focused in this region. Such enhanced support and padding is specifically disposed at and tailored tightly to the central area 18 and does not extend into the outer area 20 where the extra bulk thereof could interfere with movement of the cyclist's body, thus resulting in discomfort to the cyclist.

The region of the seat pad 10 indicated by the outer area 20 comprises less than all of the inner, middle, and outer layers 40, 42, and 44. In one embodiment, this outer area is composed of only the inner layer 40, that is, the middle and outer layers 42 and 44 do not extend to the outer area 20. See FIGS. 9*a* and 9*b*. In another embodiment of the seat pad 10, a thin foam padding portion of the middle layer 42 extends from the central area 18 into the outer area 20 to provide a degree of padding and support to the cyclist. Still, in such embodiment of the seat pad 10, the outer area 20 is substantially thinner than the central area 18.

More particularly, the outer area 20 includes an overall thickness of approximately two to eight millimeters and, more particularly, includes a thickness of approximately three millimeters. In one embodiment, the lower abdominal portion 32 of the outer area 20 has a slightly increased thickness of, for example, approximately four to eight millimeters and, in another embodiment, includes a thickness of approximately six millimeters.

The outer area 20 is designed to provide sufficient support to the cyclist as well as padding against impact with the cycle seat. However, as discussed, the outer area 20 is formed generally thinner than the central area 18 to reduce an overall bulkiness of the seat pad 10, thus providing a lighter-weight, more flexible and, hence, more comfortable seat pad. It is particularly noted that the upper thigh portions 30 are, for example, a mere three millimeters in thickness, less than half the thickness of the central area 18. In this way, maximum support and padding is provided to the cyclist where such is needed the most, in the region designated by the central area 18, while the other areas, particularly, the upper thigh portions 30, remain thin thus providing the user with a full unobstructed range of movement in this region.

In an alternative embodiment, the seat pad can be made of a single-layered compressible element. It can include a plurality regions having distinct thicknesses to increase the cyclist's comfort.

Figure 7:
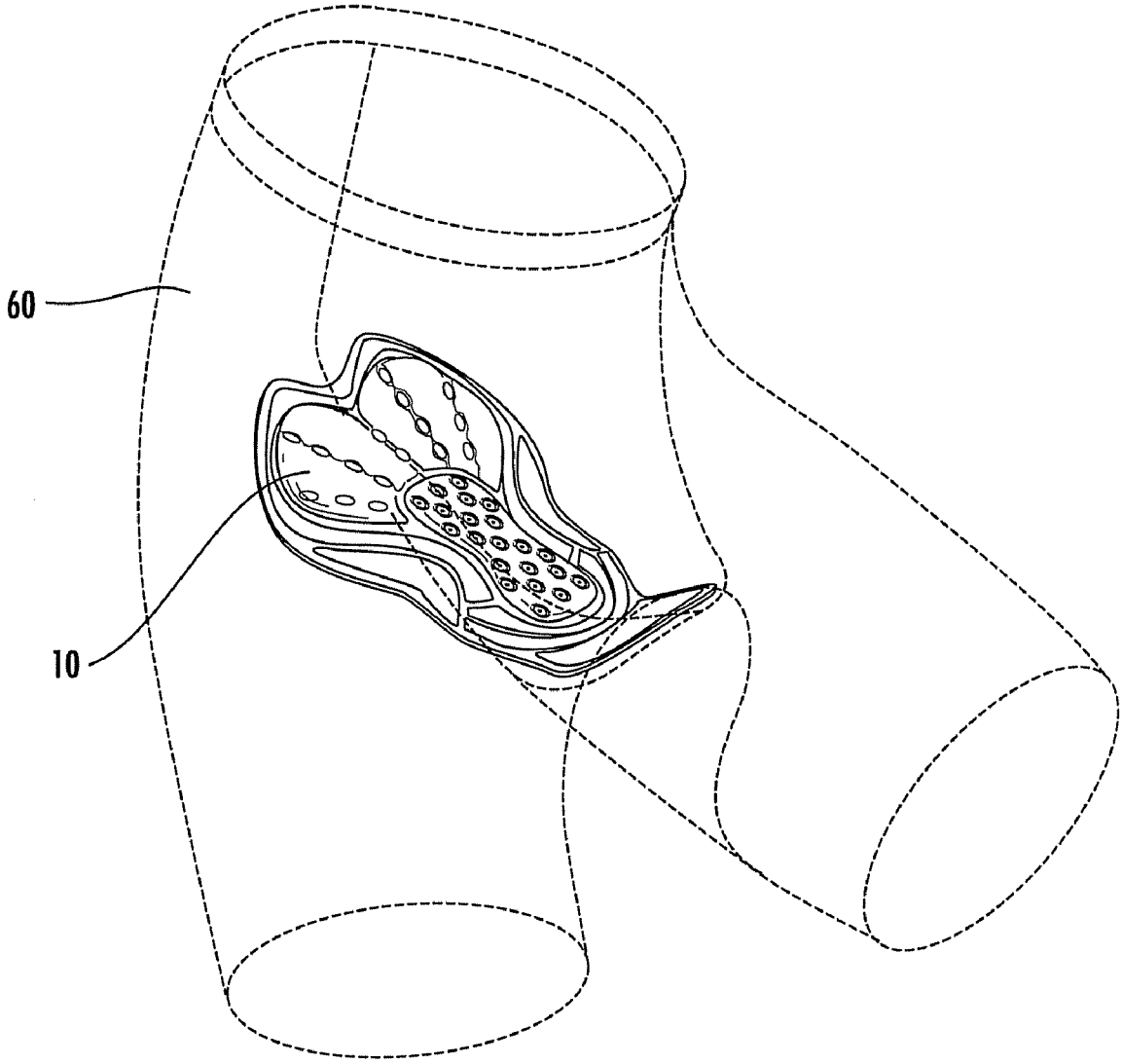
FIG. 7 is a perspective view of the seat pad disposed in a cycling garment.

The seat pad 10, in one embodiment, is fixed to a cycling garment 60 as shown in FIG. 7. The garment 60 comprises any clothing item to be worn by the cyclist proximate the groin and crotch area such as, for example, cycling pants, shorts, underwear, etc. The seat pad 10 is fixed to the cycling garment 60 by any suitable method including, but not limited to, stitching, temperature or fusion bonding, adhering with a bonding agent, etc., and any combination thereof.

Figure 8:
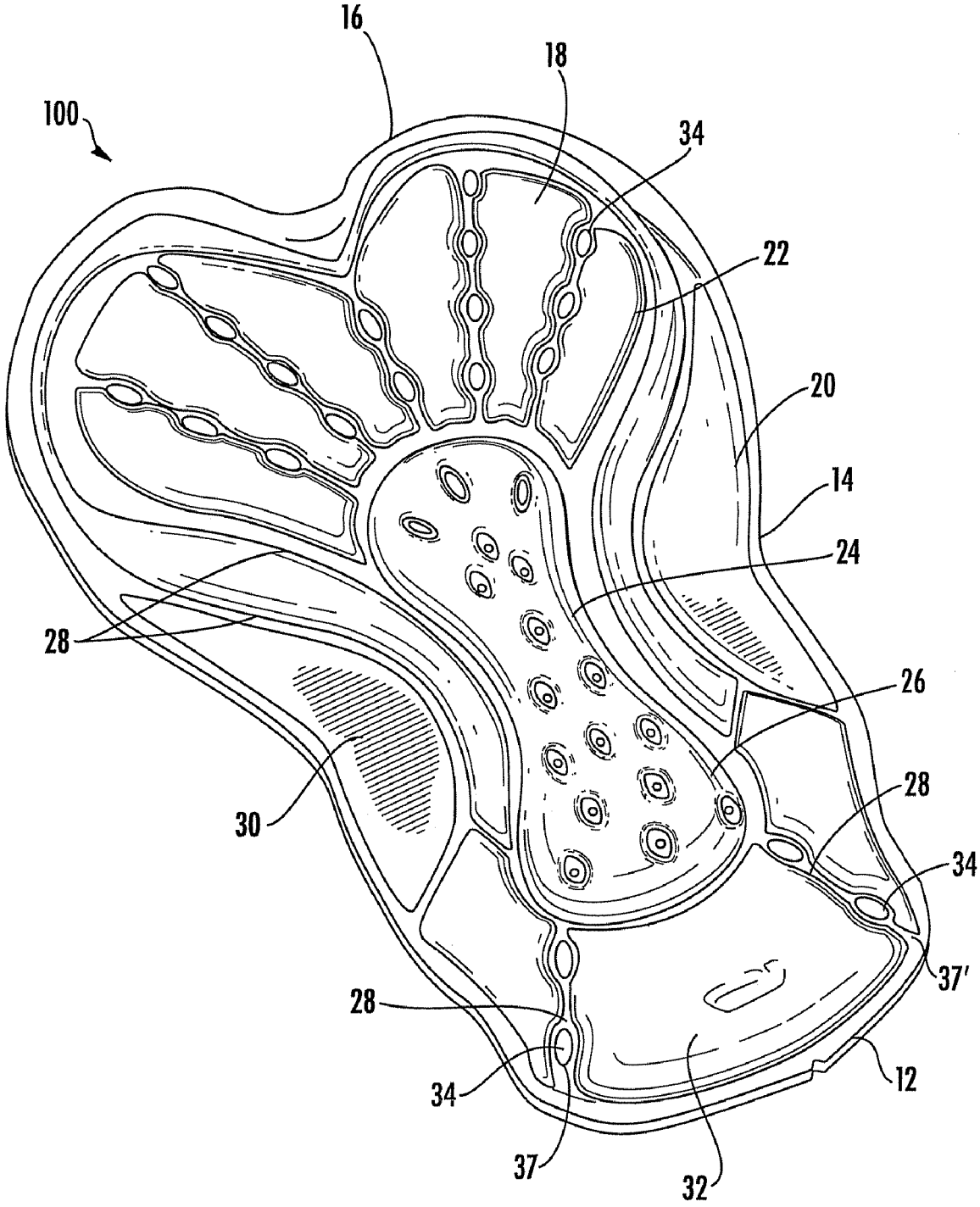
FIG. 8 is a perspective view of a seat pad in another exemplary embodiment of the invention.
Figure 9:
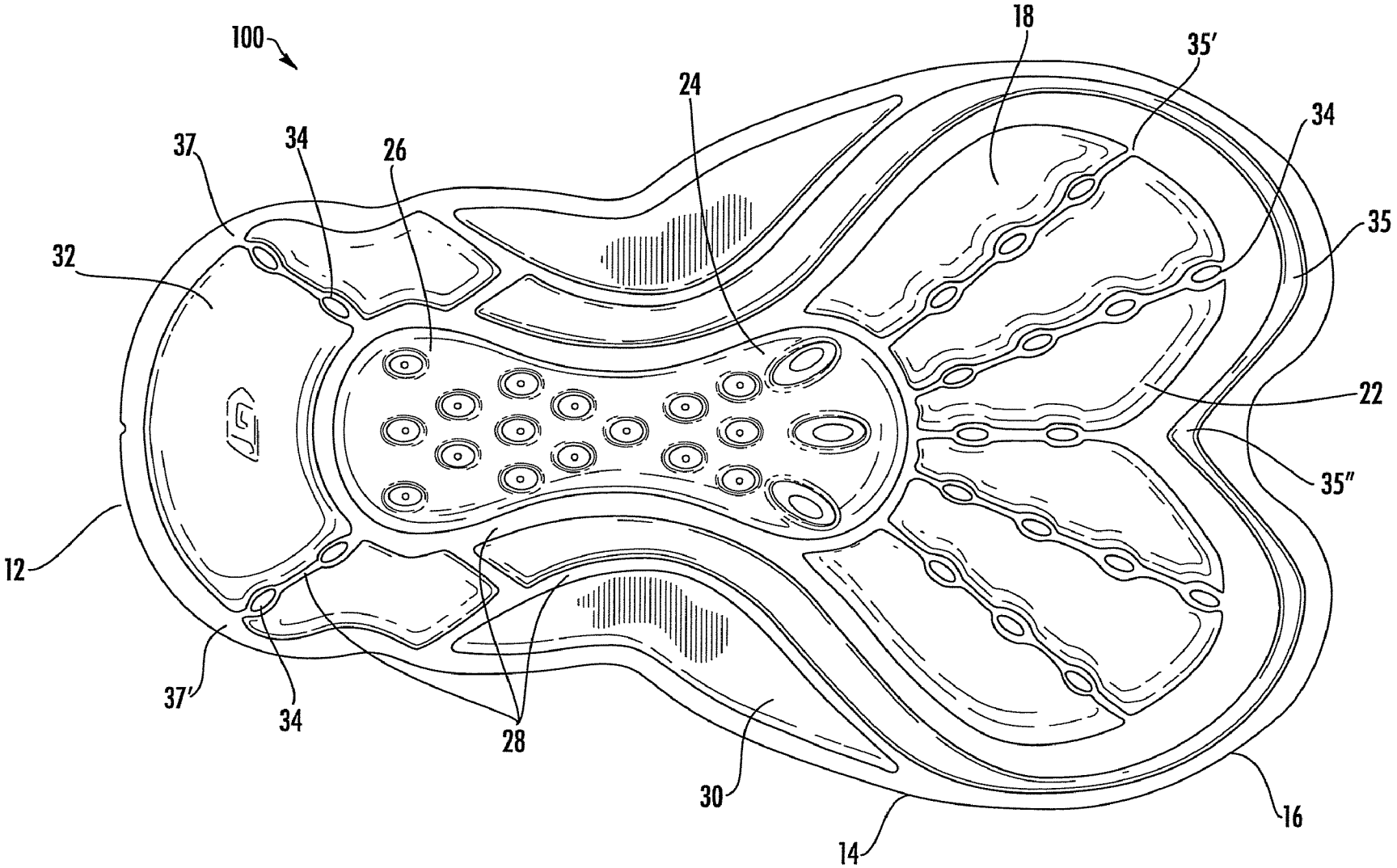
FIG. 9 is a top plan view of the seat pad of FIG. 8.
Figure 10:
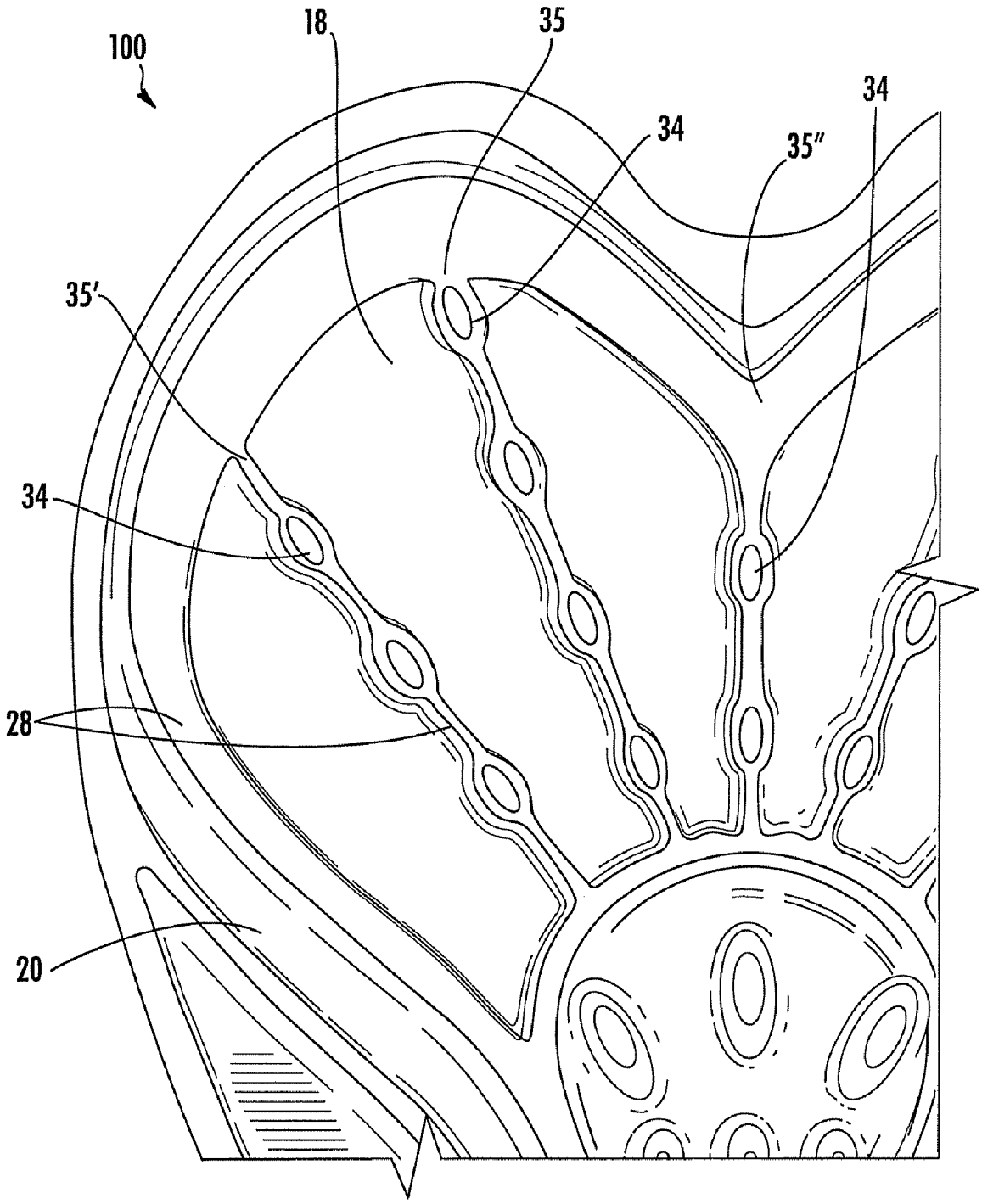
FIG. 10 is an enlarged view of a portion of FIG. 9.

FIGS. 8-10 show a seat pad 100 in another embodiment of the invention. The seat pad 100 is generally a padded substantially planar element intended to be disposed in a cycling garment for providing a female cyclist with enhanced comfort while sitting upon and riding a bicycle or the like. The elements of the seat pad 100 are identical, in many respects, to those disclosed and discussed above with respect to the seat pad 10. Elements consistent in the seat pads 10 and 100 are indicated by consistent reference numerals.

The seat pad 100 includes the front portion 12, the intermediate portion 14 and the rear portion 16. The seat pad 100 includes, generally, the same shape as the seat pad 10. However, the seat pad 100 is somewhat smaller than the seat pad 10. Specifically, the front portion 12 and the intermediate portion 14 of the seat pad 100 are generally narrower than those of the seat pad 10. Further, the front portion 14 of the seat pad 100 does not extend as far as that of the seat pad 10. That is, lower abdominal portion 32 of the seat pad 100 is narrower and does not extend as far as that of the seat pad 10.

The seat pad 100 includes the circular and oval perforations 34 and the channels 35, 35', and 35" as described above with respect to the seat pad 10.

The seat pad 100 can include the same multilayer structure discussed above with respect to the seat pad 10. It is noted that, as with the seat pad 10, the middle and outer layers 42, 44 of the seat pad 100 are differently shaped and smaller than the inner layer 40. All of the inner, middle, and outer layers 40, 42, and 44 are uniquely sized and shaped with respect to one another, all three layers overlapping only proximate the central region 18. It is particularly noted that the outer layer 44, which fixes the seat pad 100 to the cycling garment, does not complement or otherwise correspond to the inner layer 40.

Despite the similarities of the seat pads 10 and 100, the seat pad 100 includes thickness generally less than the corresponding thicknesses of the seat pad 10. Particularly, the seat pad 100 includes a thickness at the central area 18 of approximately six to ten millimeters and, more specifically, includes a thickness of approximately eight millimeters. The thickness of the seat pad 100 at the outer area upper thigh portions 30 of the outer area 20 is approximately one to five millimeters and, particularly, is approximately three millimeters. The thickness of the seat pad 100 at the lower abdominal portion 32 of the outer area 20 is approximately three to eight millimeters and, in another embodiment, is approximately five millimeters.

The differences in size and thickness of the seat pad 100 with respect to the seat pad 10 accounts for the unique details and requirements of the female anatomy. Still, the seat pad 100 is thickest at the central area 18 in order to provided the cyclist with maximum support and padding in this region. The pad 100 is thinner at the outer area 20, particularly at the upper thigh portions 30, to reduce bulkiness of the seat pad and to increase the flexibility and comfort properties thereof.

Accordingly, the various seat pads 10 and 100 described herein provide the cyclist with increased flexibility to facilitate conforming the seat pad to the cyclist's body, enhanced ventilation air flow for cooling and drying the cyclist, and enhanced fluid drainage for allowing extraction of perspiration, rainwater, etc., from the inner side of the seat pad to an exterior of the pad away from the body of the cyclist.

The seat pad of the invention has been generally described herein as being a member which is mounted within a pant to be worn by a cyclist, etc. Alternatively, however, the construction of the seat pad may be formed integrally within the pant. That is, it is not required that the seat pad be an element separate from the pant. The pad and its unique features may be formed integrally within the material forming the pant.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A seat pad for a cyclist garment, comprising:

a first side;

an opposing second side;

perforations formed through the seat pad so as to traverse from the first side to the second side and allow passage of fluid therethrough; and a plurality of channels defined in the first side extending substantially linearly across a buttock portion of the seat pad, each one of the channels extending radially from a rear of the seat pad toward a perineum portion and non-intersecting with the other channels, connecting together at least two of the perforations and being configured to direct fluid flow when the garment is worn.

2. The seat pad of claim 1, wherein each one of the channels comprises an area of the seat pad having a reduced thickness.

3. The seat pad of claim 1, wherein the perforations comprise a recess inset into a thickness of the seat pad and a hole formed through the seat pad at the recess.

4. The seat pad of claim 3, wherein the recesses comprise a first recess disposed at the first side and a second recess disposed at the second side, the first and second recesses being disposed oppositely and correspondingly such that the hole traverses through the seat pad from the first recess to the second recess.

5. The seat pad of claim 1, further comprising an inner layer for contacting the cyclist; an outer layer for affixing to the garment; and a compressible, resilient middle layer disposed between the outer and inner layers.

6. The seat pad of claim 5, wherein each one of the channels comprises a compressed portion of the inner and middle layers.

7. The seat pad of claim 1, wherein the perineum portion comprises a plurality of perforations, the perforations comprising a recess inset into a thickness of the seat pad and a hole formed through the seat pad at the recess.

8. The seat pad of claim 1, comprising at least one channel extending substantially linearly in an area corresponding to a crotch and/or a lower abdominal region of the cyclist, from a front of the seat pad toward the perineum portion.

9. The seat pad of claim 1, wherein each one of the channels comprises a wall for directing said fluid flow.

10. The seat pad of claim 1, wherein the seat pad comprises a generally planar elongated member having a front end and an opposing rear end, the rear end being wider than the front end.

11. The seat pad of claim 10, further comprising:

a central area for contacting a buttocks and a crotch of the cyclist, the central area extending from the rear end towards the front end of the seat pad and being disposed centrally about a longitudinal axis of the seat pad; and an outer area for contacting an upper thigh of the cyclist, the outer area being disposed around the central area.

12. A cycling garment, comprising:

the seat pad of claim 1.

13. A seat pad for a cyclist garment, comprising:

a plurality of non-intersecting channels disposed along a first side of the seat pad for directing a flow of fluid and disposed in an area corresponding to a buttocks region of the cyclist;

wherein at least one of the channels is delimited by a plurality of perforations disposed in a substantially linear and radial fashion between a rear and a perineum portion and associated by hinge lines, at least one of the perforations including a hole extending through the seat pad.

14. The seat pad of claim 13, wherein the channel comprises an area of the seat pad having a reduced thickness.

15. A seat pad for a cyclist garment, comprising:

aeration holes extending through the pad and having a first port opening on a first surface of the seat pad and a second port opening on a second surface, opposed to the first surface; and a plurality of recessed fluid escape channels defined on the first surface, extending substantially linearly between at least two of the aerations holes, across a buttock portion of the seat pad, from a rear of the seat pad toward a perineum portion, and being in fluid communication with the first ports of the at least two aeration holes, the channels extending substantially radially between the rear of the seat pad and the perineum portion and non-intersecting with one another.

16. A seat pad of claim 15, wherein at least one of the aeration holes is surrounded by a recessed area.

17. The seat pad of claim 16, wherein the recessed areas and the recessed fluid escape channels formed through the seat pad includes a portion of the seat pad being permanently compressed.

18. The seat pad of claim 15, wherein each one of the recessed fluid escape channels comprises an area of the seat pad having a reduced thickness.

* * * * *